US010498094B2

(12) United States Patent
Tsukamoto

(10) Patent No.: US 10,498,094 B2
(45) **Date of Patent: *Dec. 3, 2019**

(54) CONNECTOR

(71) Applicant: Yazaki Corporation, Tokyo (JP)

(72) Inventor: Masashi Tsukamoto, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/131,349

(22) Filed: Sep. 14, 2018

(65) Prior Publication Data

US 2019/0109418 A1 Apr. 11, 2019

(30) Foreign Application Priority Data

Oct. 5, 2017 (JP) ..... 2017-195316

(51) Int. Cl.

| | |
|---|---|
| ***H01R 13/7193*** | (2011.01) |
| ***H01R 4/24*** | (2018.01) |
| ***H01R 13/7195*** | (2011.01) |
| *H01R 13/506* | (2006.01) |
| *H01R 13/64* | (2006.01) |

(52) U.S. Cl.

CPC ..... *H01R 13/7193* (2013.01); *H01R 4/24* (2013.01); *H01R 13/7195* (2013.01); *H01R 13/506* (2013.01); *H01R 13/64* (2013.01)

(58) Field of Classification Search

CPC ..... H01R 13/719; H01R 13/7193; H01R 4/2445–2466

See application file for complete search history.

(56) References Cited

U.S. PATENT DOCUMENTS

| | | | | |
|---|---|---|---|---|
| 7,307,495 | B2 * | 12/2007 | McLauchlan ..... | H01R 4/2433 333/184 |
| 7,841,911 | B2 * | 11/2010 | Aizawa ..... | H01R 31/065 439/723 |
| 8,992,259 | B2 * | 3/2015 | Miwa ..... | H01R 13/506 439/620.05 |

(Continued)

FOREIGN PATENT DOCUMENTS

| | | | |
|---|---|---|---|
| JP | 06-076887 | A | 3/1994 |
| JP | 2008-66157 | A | 3/2008 |
| JP | 2012-69270 | A | 4/2012 |

*Primary Examiner* — Xuong M Chung Trans
(74) *Attorney, Agent, or Firm* — Sughrue Mion, PLLC

(57) ABSTRACT

A connector is equipped with a housing capable of being fitted in a mating connector, a plurality of terminals which are held in the housing and electrically connected to each other, and a noise reduction member or members which are held in the housing. The mating connector is connected to brunch lines among a trunk line and the brunch lines constituting an electric circuit. One of the plurality of terminals is a trunk-line connection terminal which is a pressure contact terminal and is electrically connected to the trunk line directly, and a remaining terminals are branch-line connection terminals which are male terminals or female terminals and are electrically connected to the respective branch lines when the housing is connected to the mating connector. The noise reduction member is not disposed at the trunk-line connection terminal, and the noise reduction member is disposed at the branch-line connection terminal.

4 Claims, 7 Drawing Sheets

(56) References Cited

U.S. PATENT DOCUMENTS

| | | | | |
|---|---|---|---|---|
| 9,379,493 | B2 * | 6/2016 | Aizawa | H01R 13/6588 |
| 2013/0303023 | A1 | 11/2013 | Miwa et al. | |
| 2019/0109416 | A1 * | 4/2019 | Tsukamoto | H01R 13/6585 |
| 2019/0109417 | A1 * | 4/2019 | Tsukamoto | H01R 13/424 |

* cited by examiner

CONNECTOR

CROSS-REFERENCES TO RELATED APPLICATIONS

This application is a based on a claims priority from Japanese Patent Applications No. 2017-195316 filed on Oct. 5, 2017, the entire contest of which are incorporated herein by reference.

BACKGROUND OF THE INVENTION

Technical Field

The present invention relates to a connector having a plurality of terminals that are electrically connected to each other.

Background Art

Connectors are known widely that are equipped with a housing that holds plural terminals that are electrically connected to each other. Connectors of this type are also called joint connectors. Joint connectors are typically used being fitted in a mating connector that is connected to a trunk line and branch lines, to have the branch lines branch off the trunk line that constitutes an electric circuit.

In a case that a joint connector is used to have branch lines branch off a trunk line, noise (ringing) is prone to occur due to reflection waves mainly in the branch lines which are larger in terminal resistance than the trunk line.

To suppress such noise, in one conventional joint connector, every terminal held in a housing is provided with a noise reduction member for reducing noise (refer to Patent document 1, for example). Since the noise reduction members are provided for all of the terminals, respectively, one type of joint connector, that is, a common connector, can be applied to a number of electrical circuits.

Patent document 1: JP-A-2012-69270

SUMMARY OF THE INVENTION

Where a joint connector is used to have branch lines branch off a trunk line, noise is not prone to occur in the trunk line which is smaller in terminal resistance than the branch lines. Among the branch lines, short ones are less prone to noise like the trunk line because they are small in terminal resistance. In other words, among the plurality of terminals of a joint connector there may exist terminals that are low in the necessity to be provided with a noise reduction member.

In the above conventional joint connector, the noise reduction members are provided for all of the terminals, respectively, though there exist terminals that are low in the necessity to be provided with a noise reduction member. This results in size increase and cost increase of the joint connector as a whole. It is desirable to minimize such size increase and cost increase of a joint connector.

Furthermore, where as described above branch lines are caused to branch off a trunk line by fitting a joint connector into or with a mating connector that is connected to the trunk line and the branch lines, it is necessary to perform work of attaching terminals for connection to the mating connector to end portions of two divisional trunk lines produced by dividing the original trunk line at a position corresponding to the mating connector. It is desirable to make such work necessary for connection of the trunk line as easy as possible.

The present invention has been made in view of the above circumstances, and an object of the present invention is therefore to provide a connector that is used to have branch lines branch off a trunk line and that can suppress its size increase and cost increase and facilitate work necessary for connection of the trunk line.

To attain the above object, the present invention provides connectors having features that are described below in the form of items (1) to (5):

(1) A connector comprising:

a housing capable of being fitted in a mating housing of a mating connector;

a plurality of terminals which are held in the housing and electrically connected to each other; and a noise reduction member which is held in the housing and disposed at at least one of the plurality of terminals so as to reduce noise occurring in the at least one of the plurality of terminals, wherein the mating connector is connected to a brunch line among a trunk line and the brunch line constituting an electric circuit;

the connector is connected to the trunk line;

the plurality of terminals includes trunk-line connection terminals which are electrically connected to the trunk line directly and branch-line connection terminals which are electrically connected to the branch line when the housing is connected to the mating housing;

the noise reduction member is not disposed at the trunk-line connection terminals; and the noise reduction member is disposed at at least one of the branch-line connection terminals or all of the plurality of branch-line connection terminals.

(2) The connector according to item (1), wherein the housing has a trunk wire housing portion which houses the trunk line that press-contacts with the trunk-line connection terminal.

(3) The connector according to item (1) or (2), wherein the noise reduction member is made of a material containing ferrite.

(4) The connector according to item (1), wherein the trunk-line connection terminal is a pressure contact terminal, and the branch-line connection terminal is a male terminal or a female terminal.

(5) The connector according to item (1), wherein one of the plurality of terminals is the trunk-line connection terminal, and the remaining terminals other than the one of the plurality of terminals is the branch-line connection terminals.

In the connector (joint connector) according to the present invention, no noise reduction member is provided for the one trunk-line connection terminal that is not prone to noise and a noise reduction member is provided for all or part of the branch-line connection terminals that are prone to noise. In this manner, where the connector is used to have branch lines branch off a trunk line, the noise reduction member(s) can be provided properly for only the terminals where noise is relatively prone to occur. As a result, size increase and cost increase of the connector as a whole can be suppressed unlike in the above-described conventional connector.

Furthermore, since the trunk line is directly brought into pressure contact with the trunk-line connection terminal which is a pressure contact terminal without intervention of the mating connector, unlike in the conventional connector, work of dividing the original trunk line and providing noise reduction members for end portions of resulting two divisional trunk lines is not necessary. This makes work of connecting the trunk line easier than in the conventional connector. Furthermore, since the trunk line need not be provided with terminals, the number of components can be reduced. And since the trunk line is not divided, a phenomenon can be prevented that the communication performance is degraded by division of the trunk line W1.

Where a plurality of connectors are connected together in series via a trunk line, the noise reduction members are not disposed at an unduly large number of locations along the trunk line which extends being connected to the plurality of connectors. Thus, when a signal is transmitted from the side of one end of the trunk line to the side of its other end, a phenomenon is not prone to occur that an output signal waveform is distorted too much with respect to an input signal waveform due to disposition of noise reduction members at a large number of locations along the trunk line. This will be described later in detail.

According to the connector of the present invention, since the trunk line that is in pressure contact with the trunk-line connection terminal is housed in the trunk wire housing portion of the housing, the load due to, for example, external force acting on the portion where the trunk line is connected to the trunk-line connection terminal can be made smaller than in a case that the trunk line is not housed in the trunk wire housing portion. As a result, the reliability of the electrical connection between the trunk-line connection terminal and the trunk line can be increased.

According to the connector of the present invention, since the noise reduction member or members are made of a material containing ferrite which is very high in noise reducing ability, the noise reducing effect can be exercised stably and reliably.

The present invention can provide a connector that is used to have branch lines branch off a trunk line and that can suppress its size increase and cost increase and facilitate work necessary for connection of the trunk line.

The present invention has been described above concisely. The details of the present invention will become more apparent when the modes for carrying out the present invention (hereinafter referred to as an embodiment) described below are read through with reference to the accompanying drawings.

DESCRIPTION OF THE PREFERRED EMBODIMENT

A specific embodiment of the present invention will be hereinafter described with reference to the drawings.

Embodiment

Figure 1:
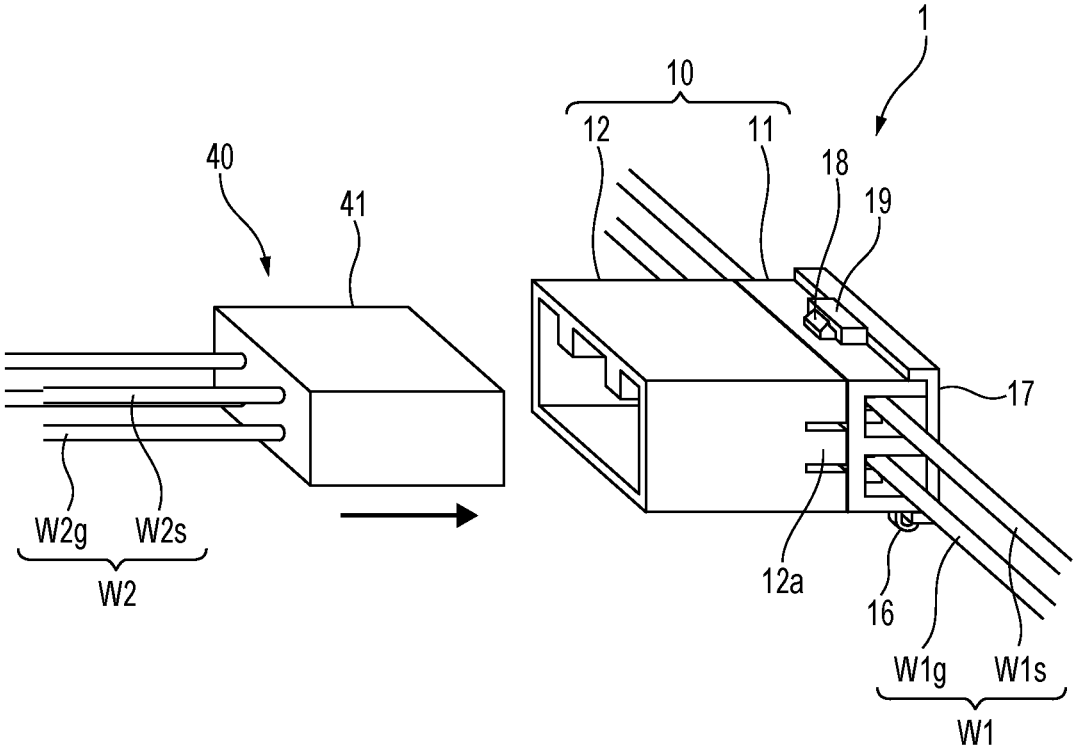
FIG. 1 is a perspective view of a connector according to an embodiment of the present invention and a counter connector to be fitted into the connector.

A connector 1 according to the embodiment of the present invention will be hereinafter described with reference to the drawings. The connector 1, which is also called a joint connector, has a plurality of terminals that are electrically connected to each other. As shown in FIG. 1, the connector 1 is used being fitted with a mating connector 40 that is connected to a trunk line and branch lines, to have the branch lines branch off the trunk line that constitutes an electric circuit. The trunk line W1 which constitutes the electric circuit consists of two wires (twisted wires) W1*s* and W1*g* for transmitting a signal in "two-wire differential voltage form." Each branch line W2 which constitutes the electric circuit consists of two wires (twisted wires) W2*s* and W2*g*.

Figure 2:
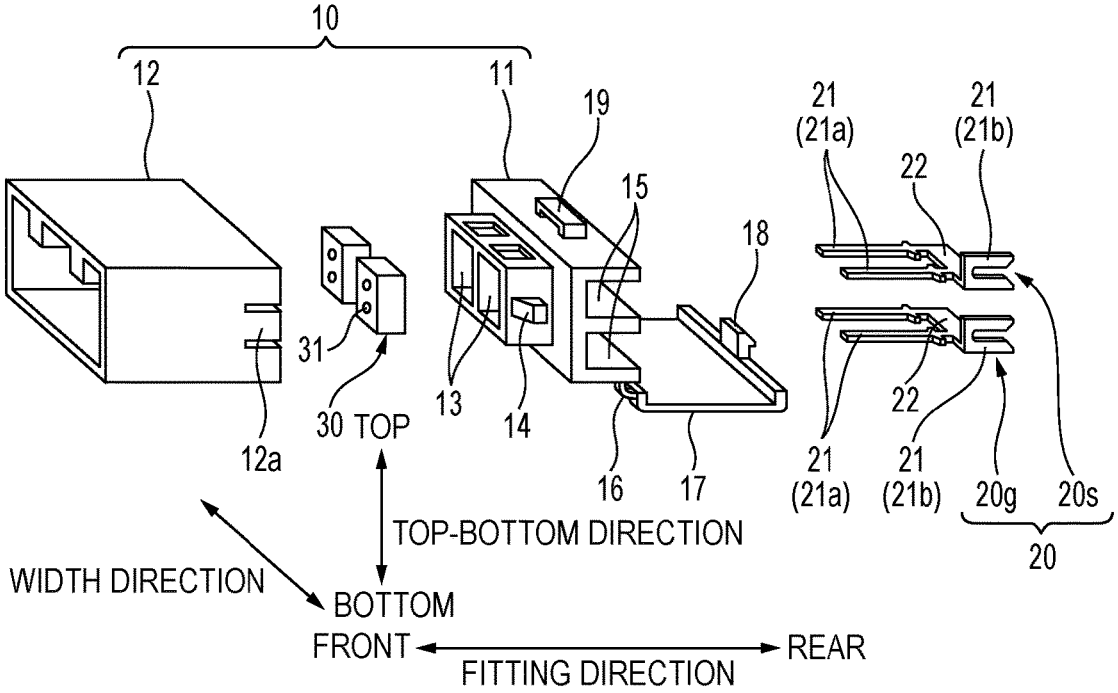
FIG. 2 is an exploded perspective view of the connector according to the embodiment of the present invention.

As shown in FIG. 2, the connector 1 according to the embodiment of the present invention is equipped with a housing 10, busbars 20 which are held in the housing 10, and noise reduction members 30 which are held in the housing 10. In the following description, for the sake of convenience, the fitting direction, the width direction, the top-bottom direction, the front side, the rear side, the top, and the bottom are defined as shown in FIG. 2. The fitting direction, the width direction, the top-bottom direction are perpendicular to each other.

The housing 10 is made of a resin and is composed of a main housing 11 and a hood housing 12 which is attached to the main housing 11 from the front side.

Noise reduction member holding rooms 13 for holding respective noise reduction members 30 are formed inside a front cuboid-shaped portion of the main housing 11. In the embodiment, two noise reduction member holding rooms 13 are defined and formed so as to be arranged in the width direction. Each noise reduction member holding room 13 is a cuboid-shaped recess that conforms to the shape of each noise reduction member 30 and has a front opening. The rear wall of the noise reduction member holding rooms 13 is formed with two (upper and lower) through-holes (not shown) which extend in the front-rear direction and through which terminals 21 (21*a*) of the busbars 20 are inserted.

The two outer side surfaces of the front cuboid-shaped portion of the main housing 11 are formed with respective lock projections 14 which project outward in the width direction and on which the hood housing 12 is locked.

A rear cuboid-shaped portion of the main housing 11 is formed with, at two (upper and lower) levels, trunk wire housing portions 15 for housing trunk line W1. Each trunk wire housing portion 15 is a groove that is open on the rear side and penetrates through the main housing 11 in the width direction. The upper and lower trunk wire housing portions 15 are the same in shape and house the two respective wires W1*s* and W1*g* of the trunk line W1 which extends straightly. The front wall of the trunk wire housing portions 15 (grooves) is also the rear wall of the noise reduction member holding rooms 13. Thus, the upper and lower through-holes that are formed through the rear wall of the noise reduction member holding rooms 13 penetrate through the front wall of the upper and lower trunk wire housing portions 15.

A lid 17 is connected, via a hinge 16, to a bottom-rear edge of the rear cuboid-shaped portion of the main housing 11 rotatably so as to be able to close and open. The lid 17 is provided to close the openings of the two (upper and lower) trunk wire housing portions 15. A tip strip of the lid 17 is formed with a lock nail 18 at the center in the width direction. The lid 17 can be kept closed by engaging the lock nail 18 with an engagement portion 19 which is formed on the top wall of the rear cuboid-shaped portion of the main housing 11.

The noise reduction members 30 are members that are disposed so as to correspond to terminals 21 (21*a*) of the busbars 20 to reduce noise (e.g., noise due to reflection waves) occurring in the terminals 21 (21*a*) of the busbars 20. Each noise reduction member 30 is a block that is approximately shaped like a cuboid so as to conform to the shape of each noise reduction member holding room 13, and, in the embodiment, is made of ferrite. Although it is preferable that each noise reduction member 30 be made of a material containing ferrite, it may be made of any material as long as it can reduce noise occurring in the associated terminals 21. Through-holes 31 through which terminals 21 are inserted penetrate through each noise reduction member 30 at two positions in the top-bottom direction.

Figure 3:
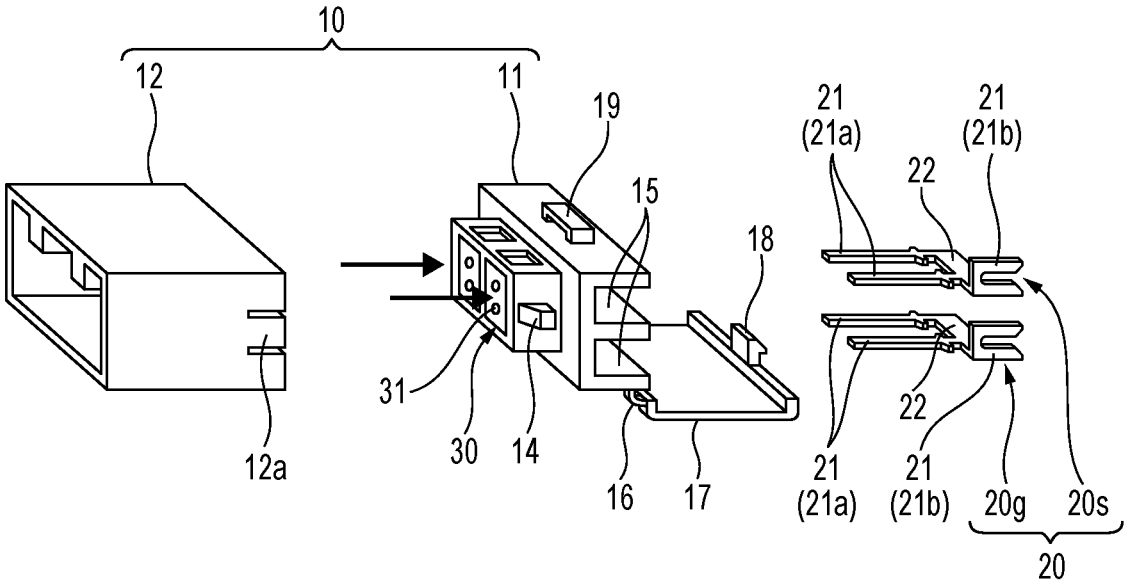
FIG. 3 is a perspective view illustrating a first stage of a process for assembling the connector shown in FIG. 1.

As shown in FIG. 3, the noise reduction members 30 are inserted into the two respective noise reduction member holding room 13 individually from the front side and held in them. In a state that each noise reduction member 30 is held in the associated noise reduction member holding room 13, the upper and lower through-holes 31 share the same axes as the upper and lower through-holes of the rear wall of the associated noise reduction member holding room 13, respectively.

Figure 4:
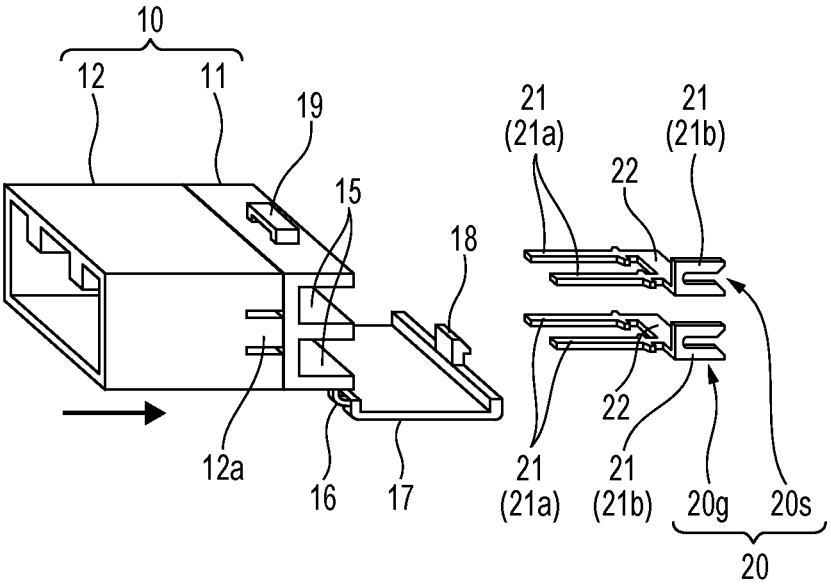
FIG. 4 is a perspective view illustrating a second stage of the process for assembling the connector shown in FIG. 1.

The hood housing 12 is approximately shaped like a rectangular pipe. As shown in FIG. 4, the hood housing 12 is attached to the main housing 11 from the front side so that the front cuboid-shaped portion of the main housing 11 is inserted into it. An attachment-completed state of the hood housing 12 is maintained (i.e., the hood housing 12 is prevented from coming off the main housing 11) because a pair of lock nails 12*a* which are formed in two respective side walls (arranged in the width direction) of the hood housing 12 are engaged with the pair of lock projections 14 of the main housing 11.

The metal busbars 20 are a signal wire busbar 20*s* and a grounding wire busbar 20*g* which are the same in shape. In the following description, each of the busbars 20*s* and 20*g* will be referred to as a "busbar 20" unless they need to be discriminated from each other.

Each busbar 20 is formed by a plurality of (in the embodiment, two) branch-line connection terminals 21*a* which are arranged parallel with each other, a link portion 22 which links the rear ends of the two branch-line connection terminals 21*a*, and one trunk-line connection terminal 21*b* which is connected to one end of the link portion 22. The branch-line connection terminals 21*a* are male terminals and the trunk-line connection terminal 21*b* is a pressure contact terminal. In the following description, the branch-line connection terminals 21*a* and the trunk-line connection terminal 21*b* will be referred to as "terminals 21" unless the former need to be discriminated from the latter.

Figure 5:
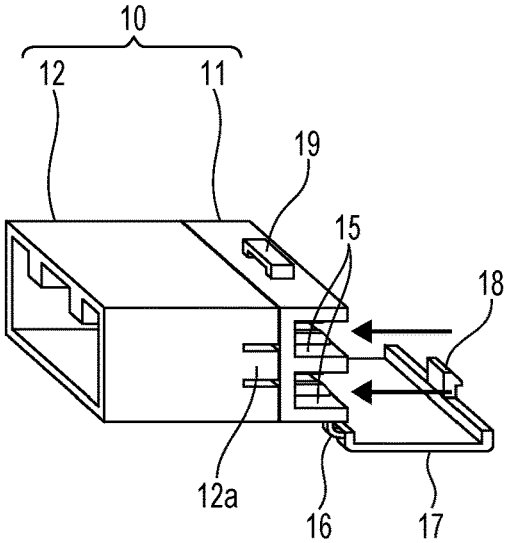
FIG. 5 is a perspective view illustrating a third stage of the process for assembling the connector shown in FIG. 1.

As shown in FIG. 5, in a state that the lid 17 is open, the busbar 20*s* is inserted into the main housing 11 from the rear side so that the terminals 21*a* are inserted through the upper through-holes of the front wall of the upper trunk wire housing portion 15 (i.e., the rear wall of the noise reduction member holding rooms 13) and the upper through-holes 31 of the noise reduction members 30. The busbar 20*g* is inserted into the main housing 11 from the rear side so that the terminals 21*a* are inserted through the lower through-holes of the front wall of the lower trunk wire housing portion 15 (i.e., the rear wall of the noise reduction member holding rooms 13) and the lower through-holes 31 of the noise reduction members 30. The link portions 22 of the inserted busbars 20*s* and 20*g* are press-fitted in the main housing 11 at prescribed locations and thereby fixed to the main housing 11 at two (upper and lower) levels so as to be parallel with each other.

In a state that fixing of the busbars 20*s* and 20*g* is completed, the two pairs of branch-line connection terminals 21*a* are located at two (upper and lower) levels and project forward beyond the front surfaces of the noise reduction members 30. In other words, an upper terminal 21*a* that is one of the two branch-line connection terminal 21*a* of the signal wire busbar 20*s* and a lower terminal 21*a* that is a corresponding one of the two terminals 21*a* of the grounding wire busbar 20*g* are arranged at the two levels in the top-bottom direction and project beyond the front surface of the main housing 11. The portions, projecting beyond the front surface of the main housing 11, of the plurality of terminals 21*a* (the four terminals 21*a* in total arranged at the two (upper and lower) levels in the top-bottom direction) are located in the internal space of the hood housing 12. Thus, the four terminals 21*a* in total protected from outside by the hoof housing 12.

Since as described above the noise reduction members 30 are held in the two respective noise reduction member holding rooms 13, each noise reduction member 30 is disposed so as to bridge two (upper and lower) terminals 21*a* (branch-line connection terminals 21*a*) for a signal wire and a grounding wire. As a result, noise occurring between these two branch-line connection terminals 21*a* is reduced.

On the other hand, in a state that fixing of the busbars 20*s* and 20*g* is completed, the trunk-line connection terminal 21*b* of the busbar 20*s* is located inside the upper trunk wire housing portion 15 and the trunk-line connection terminal 21*b* the busbar 20*g* is located inside the lower trunk wire housing portion 15. No noise reduction member 30 is provided for either of the trunk-line connection terminals 21*b* of the busbars 20.

Figure 6:
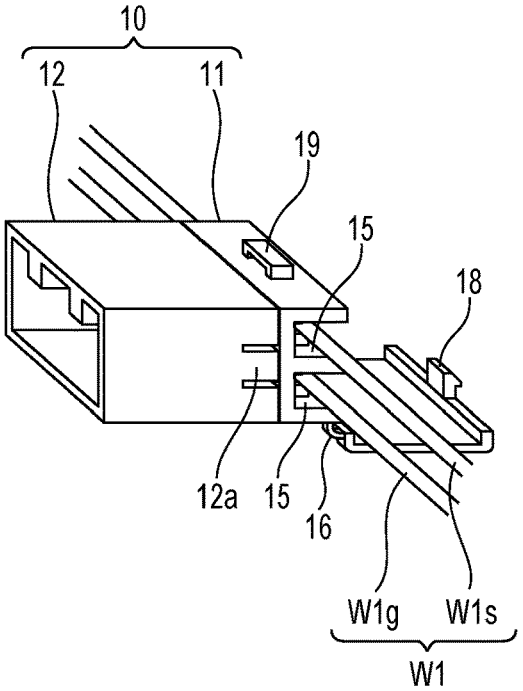
FIG. 6 is a perspective view illustrating a fourth stage of the process for assembling the connector shown in FIG. 1.

After the completion of fixing of the busbars 20*s* and 20*g*, as shown in FIG. 6, the signal wire W1*s* and the grounding wire W1*g* of the trunk line W1 are inserted into the upper and lower trunk wire housing portions 15 and brought into pressure contact with the trunk-line connection terminals 21*b* of the busbars 20*s* and 20*g*, respectively. That is, the trunk line W1 is directly brought into pressure contact with the trunk-line connection terminals 21*b* without intervention of the mating connector 40.

In the state that the trunk line W1 is in direct pressure contact with the trunk-line connection terminals 21*b*, the lock nail 18 of the lid 17 is engaged with the engagement portion 19 of the main housing 11 by rotating the lid 17 in the closing direction, whereby the lid 17 is kept closed. As a result, the state that the trunk line W1 is held in the trunk wire housing portions 15 is maintained and the attachment of the connector 1 is completed (i.e., the connector 1 shown in FIG. 1 is obtained).

Since the trunk line W1 is housed in the trunk wire housing portions 15 in the above-described manner, the load due to, for example, external force acting on the portions where the trunk line W1 is connected to the trunk-line connection terminals 21*b* can be made smaller than in a case that the trunk line W1 is not housed in the trunk wire housing portions 15. As a result, the reliability of the electrical connection between the trunk-line connection terminals 21*b* and the trunk line W1 can be increased.

As described above, in the connector 1 according to the embodiment, the noise reduction members 30 are provided for the two respective branch-line connection terminals 21*a*, prone to noise, of each busbar 20 and no noise reduction member 30 is provided for the one trunk-line connection terminal 21*b*, not prone to noise, of each busbar 20. In this manner, where the connector 1 is used to have branch lines W2 branch off a trunk line W1, the noise reduction members 30 can be provided properly for only the terminals where noise is relatively prone to occur.

As a result, size increase and cost increase of the connector 1 as a whole can be suppressed unlike in the above-described conventional connector in which noise reduction member holding rooms and noise reduction members are provided for all of the terminals.

Furthermore, since the trunk line W1 is directly brought into pressure contact with the trunk-line connection terminals 21*b* which are pressure contact terminals without intervention of the mating connector 40, unlike in the conventional connector, work of dividing an original trunk line and providing noise reduction members for end portions of resulting two divisional trunk lines is not necessary. This makes work of connecting the trunk line W1 easier than in the conventional connector. Furthermore, since the trunk line W1 need not be provided with terminals, the number of components can be reduced. And since the trunk line W1 is not divided, a phenomenon can be prevented that the communication performance is degraded by division of the trunk line W1.

Figure 7:
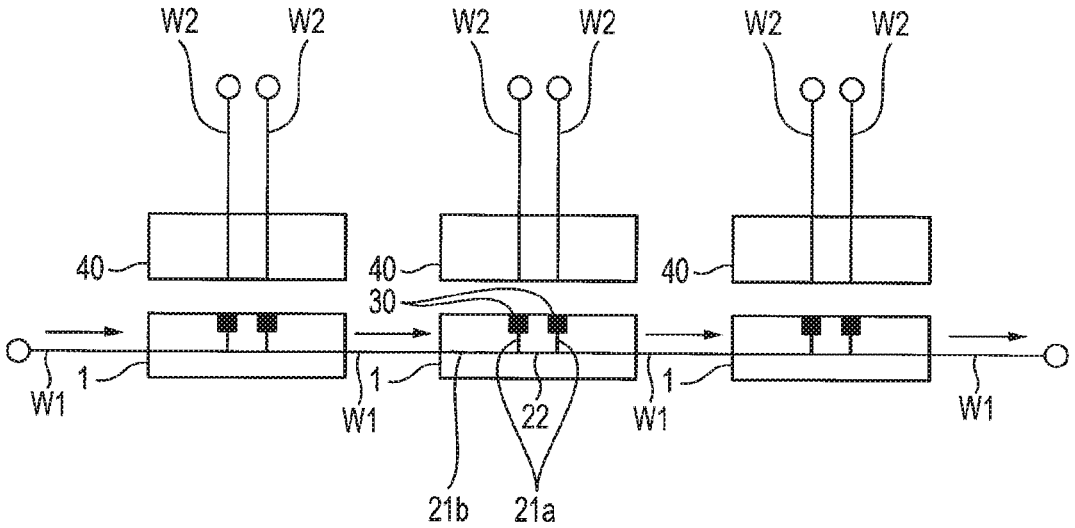
FIG. 7 is a schematic diagram showing a configuration in which connectors shown in FIG. 1 are connected together in series via a trunk line.

Next, a specific description will be made of a case that connectors 1 are used to have branch lines W2 branch off a trunk line W1 that constitutes an electric circuit. In this case, as shown in FIG. 7, connectors 1 are used in such a manner as to be fitted with respective mating connectors 40 (see FIG. 1) each of which is connected to branch lines W2 of the electric circuit. In the following description, an integrated connector formed by fitting a connector 1 with a mating connector 40 may be referred to as a "branching connector."

Figure 8:
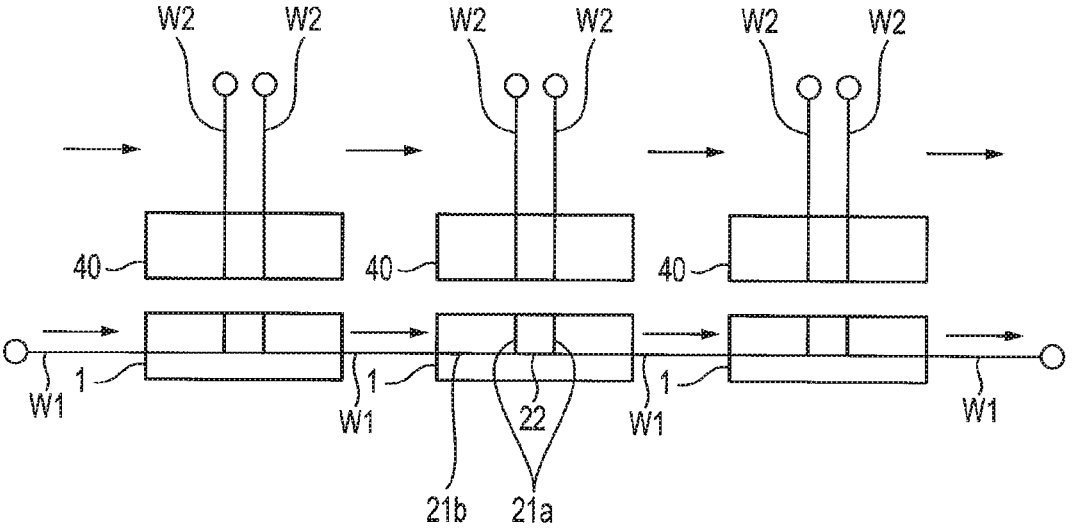
FIG. 8 is a schematic diagram that corresponds to FIG. 7 and shows a configuration of Comparative Example 1 in which no noise reduction member is provided for any terminal.
Figure 10:
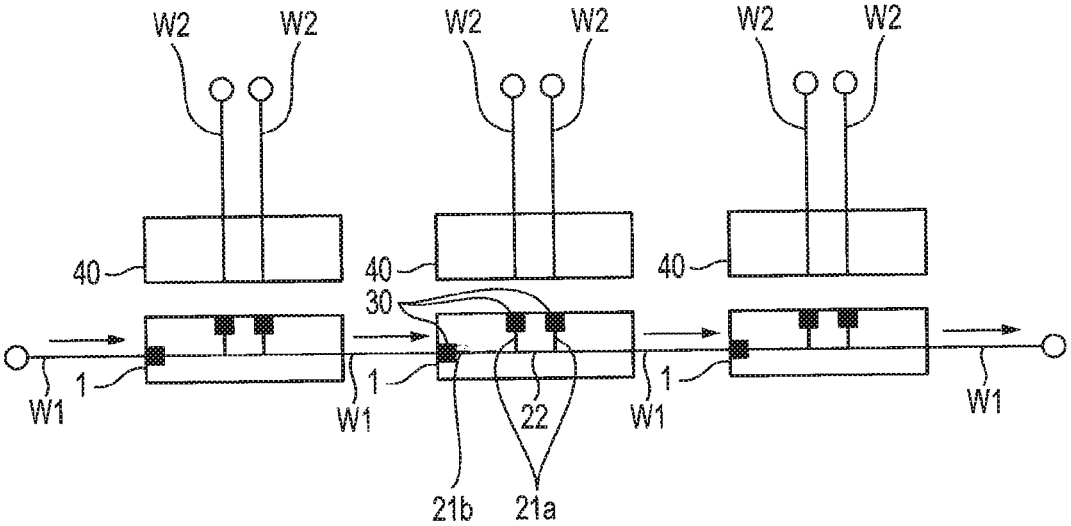
FIG. 10 is a schematic diagram that corresponds to FIG. 7 and shows a configuration of Comparative Example 2 in which a noise reduction member is provided for every terminal.

In FIG. 7, hollow circles represent electric devices (this also applies to FIGS. 8 and 10). Although in FIG. 7 each of the trunk line W1 and the branch lines W2 is drawn by a single solid line, as described above, in actuality it consists of a signal wire and a grounding wire (this also applies to FIGS. 8 and 10).

Two terminals (not shown; four terminals (female terminals) in total if a signal wire terminal and a grounding wire terminal are discriminated from each other) that are connected to four electric wires in total (if electric wires W2*s* and W2*g* constituting each brunch line are discriminated from each other) are housed in the housing 41 (FIG. 1) of each mating connector 40.

The housing 41 of each mating connector 40 is fitted into the hood housing 12 of the corresponding connector 1 (see FIG. 1). As a result, the two terminals (female terminals) housed in the housing 41 of each mating connector 40 are electrically connected to the two respective branch-line connection terminal 21*a* of the corresponding connector 1, whereby for each connector 1 (i.e., single branching connector) the trunk line W1 is electrically connected to the branch lines W2 and an electric circuit is formed in which the two branch lines W2 branch off the trunk line W1.

In the example shown in FIG. 7, the noise reduction members 30 are provided for the two branch-line connection terminals 21*a* of the busbar 20 and no noise reduction member 30 is provided for the single trunk-line connection terminal 21*b* of the busbar 2. Furthermore, three branching connectors (each consisting of a connector 1 and a mating connector 40) are connected together in series via the trunk line W1.

In the following, as a preparation for description of workings and advantages of the configuration shown in FIG. 7, first, Comparative Example 1 shown in FIG. 8 will be described in which no noise reduction member 30 is provided for either of the two branch-line connection terminal 21*a* of the busbar 20 and three branching connectors are connected together in series via the trunk line W1.

In general, in an electric circuit in which branch lines W2 branch off a trunk line W1 as in Comparative Example 1, noise (ringing) due to reflection waves is prone to occur mainly in the branch lines W2 which are larger in terminal resistance than the trunk line W1. In Comparative Example 1, when reflection waves occur mainly in the branch lines W2, noise cannot be reduced because no noise reduction member 30 is provided for either of the two terminals 21 of the busbar 20.

Thus, when as indicated by arrows in FIG. 8 a signal (e.g., an input signal having a steep rectangular waveform (represented by a broken line in FIG. 9) is transmitted from the input side (left side) of the trunk line W1 to its output wide (right side), relatively large noise is prone to occur in an output signal waveform (represented by a solid line in FIG. 9) at the output side of the trunk line W1 immediately after every time point when the input signal waveform varies.

Next, Comparative Example 2 shown in FIG. 10 will be described in which a noise reduction member 30 is provided for the two branch-line connection terminal 21*a* and one trunk-line connection terminal 21*b* of the busbar 20 and three branching connectors are connected together in series via a trunk line W1. In Comparative Example 2, a noise reduction member 30 is provided for not only the two branch-line connection terminal 21*a* but also one trunk-line connection terminal 21*b*.

Figure 9:
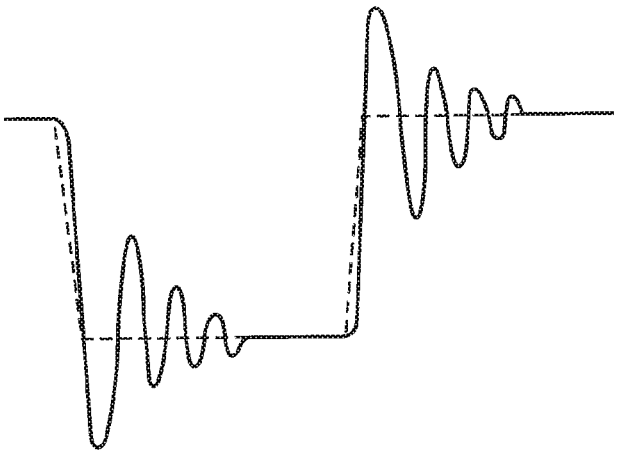
FIG. 9 shows example input and output signal waveforms that occur in a trunk line in Comparative Example 1 shown in FIG. 8.
Figure 11:
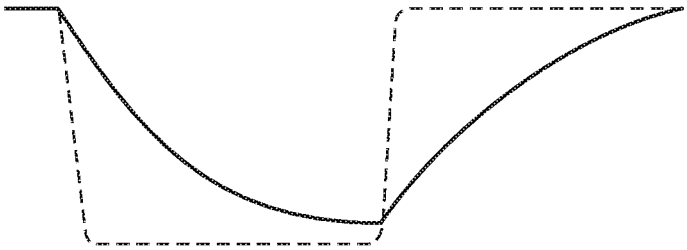
FIG. 11 shows example input and output signal waveforms that occur in a trunk line in Comparative Example 2 shown in FIG. 10.

In Comparative Example 2, when a signal having the same rectangular input signal waveform as shown in FIG. 9 is given from the input side of the trunk line W1, as shown in FIG. 11, whereas noise (ringing) is reduced sufficiently in an output signal waveform (represented by a solid line) at the output side of the trunk line W1, the output signal waveform is unduly distorted (delayed) with respect to (from) the input signal waveform.

This phenomenon is thought to be due to an excessive degree of effectuation of the noise reducing effect (similar to what is called lowpass filtering) of the noise reduction members 30 because the noise reduction members 30 are disposed at many locations (more specifically, one location per connector 1 and hence three locations in total) in the route from the input side (left side) of the trunk line W1 to its output side (right side).

Figure 12:
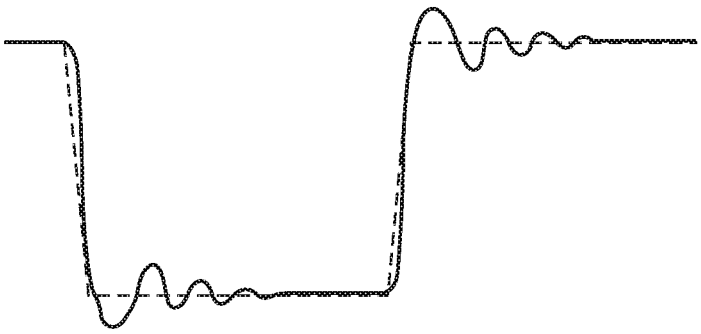
FIG. 12 shows example input and output signal waveforms that occur in the trunk line in the configuration shown in FIG. 7.

In the configuration shown in FIG. 7, in contrast to Comparative Examples 1 and 2, when a signal having the same rectangular input signal waveform as shown in FIG. 9 is given from the input side of the trunk line W1, as shown in FIG. 12 relatively large noise as shown in FIG. 9 does not occur in an output signal waveform (represented by a solid line) at the output side of the trunk line W1 immediately after each time point when the input signal waveform varies. In addition, the output signal waveform is not distorted (delayed) with respect to (from) the input signal waveform unlike in Comparative Example 2 (see FIG. 11).

This is considered due to a proper degree of effectuation of the noise reducing effect of the noise reduction members 30 because a noise reduction member 30 is provided for one trunk-line connection terminal 21*b* where noise is not prone to occur whereas noise reduction members 30 are provided for the two respective branch-line connection terminal 21*a* where noise is prone to occur.

Other Embodiment

The present invention is not limited the above embodiment, and various modifications, improvements, etc. can be made as appropriate without departing from the scope of the present invention. And the material, shape, dimensions, number (where a plurality of ones are provided), location, etc. of each constituent element of the embodiment are optional and no limitations are imposed on them as long as the present invention can be implemented.

For example, in the embodiment, as shown in FIG. 3, the two noise reduction members 30 are housed and held in the two respective noise reduction member holding rooms 13 individually and thereby provided for the two branch-line connection terminals 21*a* adjacent to each other. An alternative configuration is possible in which a single noise reduction member 30 (single block) is housed and held in a single noise reduction member holding room and thereby provided for the two branch-line connection terminals 21*a* adjacent to each other. In this case, since the number of noise reduction members 30 is made smaller than in the configuration shown in FIG. 3, for example, work of attaching the noise reduction member(s) 30 can be simplified.

In the configuration shown in FIG. 7, no noise reduction member 30 is provided for any of the trunk-line connection terminals 21*b* included in the three connectors 1 which are connected together in series. Alternatively, a noise reduction member 30 may be provided for part of the trunk-line connection terminals 21*b* included in a plurality of connectors 1 that are connected together in series.

Furthermore, in the configuration shown in FIG. 7, a noise reduction member 30 is provided for every branch-line connection terminal 21*a* of the connectors 1. An alternative configuration is possible in which no noise reduction member 30 is provided for part of the branch-line connection terminals 21*a* of connectors 1.

Still further, in the configuration shown in FIG. 2, the terminals 21 of the connector 1 are male terminals and the terminals of the mating connector are female terminals. An alternative a configuration is possible in which the terminals 21 of the connector 1 are female terminals and the terminals of the mating connector are male terminals.

Features of the connector 1 according to the embodiment of the present invention will be summarized below concisely in the form of items (1) to (5):

(1) A connector (1) comprising:

a housing (10) capable of being fitted in a mating housing (41) of a mating connector (40);

a plurality of terminals (21) which are held in the housing (10) and electrically connected to each other; and a noise reduction member (30) which is held in the housing (10) and disposed at at least one of the plurality of terminals (21) so as to reduce noise occurring in the at least one of the plurality of terminals (21), wherein the mating connector (40) is connected to a brunch line (W2) among a trunk line (W1) and the brunch line (W2) constituting an electric circuit;

the connector (1) is connected to the trunk line (W1), the plurality of terminals (21) includes trunk-line connection terminals (21*b*) which are electrically connected to the trunk line (W1) directly and branch-line connection terminals (21*a*) which are electrically connected to the branch line (W2) when the housing (1) is connected to the mating housing (41);

the noise reduction member (30) is not disposed at the trunk-line connection terminals (21*b*); and the noise reduction member (30) is disposed at at least one of the branch-line connection terminals or all of the plurality of branch-line connection terminals (21*a*).

(2) The connector (1) according to item (1), wherein the housing (10) has a trunk wire housing portion (15) which houses the trunk line (W1) that press-contacts with the trunk-line connection terminal (21*b*).

(3) The connector according to item (1), wherein the noise reduction member (30) is made of a material containing ferrite.

(4) The connector according to item (1), wherein the trunk-line connection terminal (21*b*) is a pressure contact terminal, and the branch-line connection terminal (21*a*) is a male terminal or a female terminal.

(5) The connector according to item (1), wherein one of the plurality of terminals (21) is the trunk-line connection terminal (21*b*), and the remaining terminals other than the one of the plurality of terminals is the branch-line connection terminals (21*a*).

What is claimed is:

1. A connector comprising:

a housing capable of being fitted in a mating housing of a mating connector;

a busbar including a plurality of terminals which are held in the housing and electrically connected to each other; and a noise reduction member which is held in the housing and disposed on at least one of the plurality of terminals so as to reduce noise occurring in the at least one of the plurality of terminals, wherein the mating connector is connected to a branch line among a trunk line and the branch line constituting an electric circuit;

the connector is connected to the trunk line;

the busbar including the plurality of terminals includes trunk-line connection terminals which are electrically connected to the trunk line directly and branch-line connection terminals which are electrically connected to the branch line when the housing is connected to the mating housing;

the noise reduction member is not disposed on the trunk-line connection terminals of the busbar;

the noise reduction member is disposed on at least one of the branch-line connection terminals or all of the branch-line connection terminals of the busbar;

the trunk-line connection terminal is a pressure contact terminal;

the branch-line connection terminal is a male terminal or a female terminal; and the noise reduction member comprises a through hole, and wherein the at least one of the branch-line terminals, on which the noise reduction member is disposed, is inserted through the through hole of the noise reduction member.

2. The connector according to claim 1, wherein the housing has a trunk wire housing portion which houses the trunk line that press-contacts with the trunk-line connection terminal.

3. The connector according to claim 1, wherein the noise reduction member is made of a material containing ferrite.

4. The connector according to claim 1, wherein:

one of the plurality of terminals is the trunk-line connection terminal, and the remaining terminals other than the one of the plurality of terminals is the branch-line connection terminals.

* * * * *